US008839802B2

(12) United States Patent
Lund et al.

(10) Patent No.: US 8,839,802 B2
(45) Date of Patent: Sep. 23, 2014

(54) HAIR VOLUMIZING DEVICE THAT EMPLOYS INDIVIDUAL TEETH WITHOUT LEAVING A VISIBLE PATTERN

(71) Applicant: Oomph Innovations, LLC, San Francisco, CA (US)

(72) Inventors: Patricia A. Lund, Oakland, CA (US); William M. Schwartz, San Francisco, CA (US)

(73) Assignee: Oomph Innovations, LLC, San Francisco, CA (US)

( * ) Notice: Subject to any disclaimer, the term of this patent is extended or adjusted under 35 U.S.C. 154(b) by 0 days.

(21) Appl. No.: 13/707,423

(22) Filed: Dec. 6, 2012

(65) Prior Publication Data

US 2013/0255715 A1 Oct. 3, 2013

Related U.S. Application Data

(60) Provisional application No. 61/616,955, filed on Mar. 28, 2012, provisional application No. 61/637,688, filed on Apr. 24, 2012.

(51) Int. Cl.
*A45D 2/40* (2006.01)

(52) U.S. Cl.
CPC ..... *A45D 2/40* (2013.01)
USPC ..... 132/225

(58) Field of Classification Search
USPC ..... 132/223–225, 137–138, 142; 219/225; 223/28, 32, 35–36; D28/35, 37–38
See application file for complete search history.

(56) References Cited

U.S. PATENT DOCUMENTS

| | | | | | |
|---|---|---|---|---|---|
| 1,221,447 | A * | 4/1917 | Henderson | 132/118 |
| 1,465,838 | A * | 8/1923 | Caneavri | 132/225 |
| 2,626,618 | A * | 1/1953 | Collison | 132/136 |
| 4,739,151 | A * | 4/1988 | Smal | 219/225 |
| 5,799,671 | A * | 9/1998 | Takimae | 132/225 |
| 6,386,206 | B2 * | 5/2002 | Lee | 132/225 |
| 6,615,847 | B1 * | 9/2003 | Hagelstam | 132/225 |
| 6,708,699 | B2 * | 3/2004 | McGriff, III | 132/269 |
| RE38,713 | E | 3/2005 | Habibi | |
| 6,941,955 | B2 * | 9/2005 | Yao | 132/225 |
| 7,992,578 | B2 * | 8/2011 | Tobias et al. | 132/225 |
| 2005/0284494 | A1 * | 12/2005 | Lee | 132/225 |
| 2009/0266378 | A1 * | 10/2009 | Nunomura | 132/224 |
| 2011/0017225 | A1 * | 1/2011 | Devulapalli | 132/118 |

* cited by examiner

*Primary Examiner* — Rachel Steitz
*Assistant Examiner* — Jennifer Gill
(74) *Attorney, Agent, or Firm* — Law Office of Christopher Peil; Christopher Peil

(57) ABSTRACT

A hair volumizing device designed specifically for adding lift or volume to any hairstyle. The device comprises two arms with heated interlocking plates that employ interlocking two dimensional arrays of outwardly projecting individual teeth with alternating spaces. The individual tooth design and the two-dimensional array pattern provide substantial lift and holding strength. The individual teeth of the volumizing device transforms the under layer of a person's hair into a matrix that can support the outer or upper visible layer of hair to create volume. The various embodiments also minimize any discernible pattern left in the hair.

10 Claims, 6 Drawing Sheets

HAIR VOLUMIZING DEVICE THAT EMPLOYS INDIVIDUAL TEETH WITHOUT LEAVING A VISIBLE PATTERN

CROSS REFERENCE TO RELATED APPLICATIONS

This application claims priority to provisional applications 61/616,955 filed Mar. 28, 2012 and 61/637,688 filed Apr. 24, 2012, each of which is incorporated herein in its entirety by this reference thereto.

TECHNICAL FIELD

The invention relates to hair treatment devices used for styling a person's hair. More particularly, the invention relates to a hair volumizing device that creates the outward appearance of greater hair volume without leaving an outwardly visible pattern.

DESCRIPTION OF RELATED ART

Existing hair treatment devices include a category of devices that crimp hair. These crimping devices, known as crimping irons or crimpers, impart a series of bends or creases to the hair. There are two uses of such crimping devices. A first use, and common use, is to impart a visible crimp pattern to the top layer of the hair as a distinct hairstyle, this is known as a crimped hairstyle and this process is known as crimping. A second use, as described in U.S. Pat. No. 7,992,578 is to use a crimping device to create the appearance of volume to a person's hair. This is done by applying the crimping device to an under layer of the hair. An under layer of hair is a layer of hair that is covered by an upper layer of hair and has at least a portion that is an interior hair layer that is not visible in a hair style because an upper layer of hair rests on top and hides it from view. In this method of use the under layer of hair is crimped. This causes the upper layer of hair to be lifted and held away from the head, creating the appearance of greater hair volume. This is because the outer layer of hair rests on the under layer further away from the head and scalp than it would have rested when the under layer was not crimped. Thus the upper layer is lifted and creates the appearance of more hair volume. This lifting application of the device has been accomplished heretofore by re-purposing the first use of the crimping device of creating a distinct pattern in the visible hair and using the same crimping device on an under layer of hair and not on the upper visible layer of hair.

There are many drawbacks with using a known crimping device in a lifting application because the crimping device is not specifically designed for a lifting application. A crimping application requires that the crimping device impart a distinct crimped pattern to the hair, which does, as a secondary effect, create somewhat greater volume in the hair. However, a volumizing application requires the creation of a firm support structure in the under layer of hair that can be sustained while supporting the upper layer of hair, giving the appearance of significantly greater hair volume; and that little or no discernible pattern or texture be visible, thereby leaving the basic hair style unchanged. Current hair treatment devices are not specifically designed for lifting and volumizing and do not meet these requirements.

In particular, the tooth design of crimping devices, such as in U.S. Pat. No. 7,992,578, do not meet these requirements for volumizing. These crimping devices employ a single row of long columnar, saw-tooth shaped raised teeth on heated mating and interlocking plates, which are embedded in a hand-held device that is clamped briefly on the hair. The columnar teeth in these devices extend the entire length of the heated interlocking plates. The columnar teeth run parallel to the long axis of the device.

There are many problems with the known crimping device with the arrangement of saw-tooth teeth in a hair-lifting or volumizing application including:

The arrangement of saw-tooth teeth leaves a noticeable, undesirable crimped pattern in the under layer of hair that shows through to the upper layers. The person's hair then appears visibly crimped, which is not the objective of users seeking to add volume and lift to hair without changing the hairstyle. Crimped hair shows through to the upper layers because the saw-tooth shaped columnar teeth found in existing crimping devices creates a distinct and regular pattern in the hair consisting of a series of sharp, long, accordion pleats or folds. These pleats which are as long as the length of the plates of the device are obvious in the hairstyle and tend to poke through to its upper layers. Further, any hair treatment device with columnar teeth of any shape will leave a distinct pattern in the hair when used in a volumizing application due to the length and regularity of the folds that are created in the hair. Since a goal of a hair treatment device used in a volumizing application is to create lift and volume without creating a visibly crimped hairstyle, any use of columnar teeth, sawtooth or other profile, in such a device is undesirable.

A second problem with the columnar teeth pattern in crimping devices is that it is not able to create a firm support structure in the lower layers of hair capable of supporting the upper hair layers when used in a volumizing application. This is because the sharp, saw-tooth shaped columnar teeth create a series of sharp, accordion pleats in the hair that unfold or collapse under the weight of the upper hair layers resting on them and no longer aid in volumizing the hair. As one crimped pleat or fold of hair loses structure by folding or collapsing, the load of the portion of the upper layer of hair that the pleat was supporting is transferred to the adjacent crimped pleats of hair, which in turn are now weighted with more weight than they can support, leading to collapse of all pleats of the hair treated by the device in a domino, cascading fashion. Thus, structural stability is not stable in a volumizing application done with a crimping device having saw tooth columnar teeth.

A third problem with existing crimping devices, such as found in U.S. Pat. No. 7,992,578, is that the tooth height is not adequate to lift the hair significantly up and away from the head and scalp, in order to create the appearance of substantially greater hair volume.

A fourth problem with prior art is the undesirable appearance of frizzy hair from the crimped under layer poking through to the upper layers of hair, caused by the use of closely-spaced, jagged, saw-tooth columnar teeth. Frizzy hair appears dull, kinky, and unhealthy.

SUMMARY OF THE INVENTION

An embodiment of the invention provides a hair treatment device that is optimized for lifting and volumizing hair. The volumizing device leaves little or no visible pattern or frizz in the hair and creates significantly greater and longer lasting volume in the hair. These benefits are achieved through a tooth design that employs arrays of outwardly projecting individual teeth arranged in a two-dimensional array pattern, such as a checkerboard or waffle pattern, instead of long, regular columnar, parallel teeth. The volumizing device may be for use by end users on their own hair as well as users on the hair of others, such as in salons by stylists and hair technicians.

The hair volumizing device allows users to impart significant volume or lift to hair by creating a three-dimensional matrix of hair in the under layers of the hair that serves to lift portions of the upper layers of the hair away from the head, creating the appearance of greater hair volume, without creating a clearly visible pattern in the hair. An under layer of hair is a portion of hair that is not visible in a hairstyle because it is located beneath the upper layers of hair that comprise the hair visible to others in a hairstyle. To separate an under layer from the upper visible layer of hair, a comb may be used to part the hair slightly below the point where the user typically parts the hair. The upper hair is separated and hair clips may be used to keep it out of the way while the under layer is being treated. The selected under layer of hair, is then treated with the volumizing device. This process can be repeated all over the head in order to lift hair away from the scalp, giving the appearance of greater hair volume. Users may treat only the portion of hair closest to where it leaves the scalp or they may additionally treat hair as far down the hair shaft as they desire.

A volumizing sub-structure in the under layers of the hair is created by clamping the hair between the interlocking plates of the volumizing device, which are made up of arrays of outwardly projecting individual teeth. The plates are heated and briefly clamped on the under layers of hair in order to create structural support for the upper layers.

DETAILED DESCRIPTION OF THE INVENTION

Figure 1:
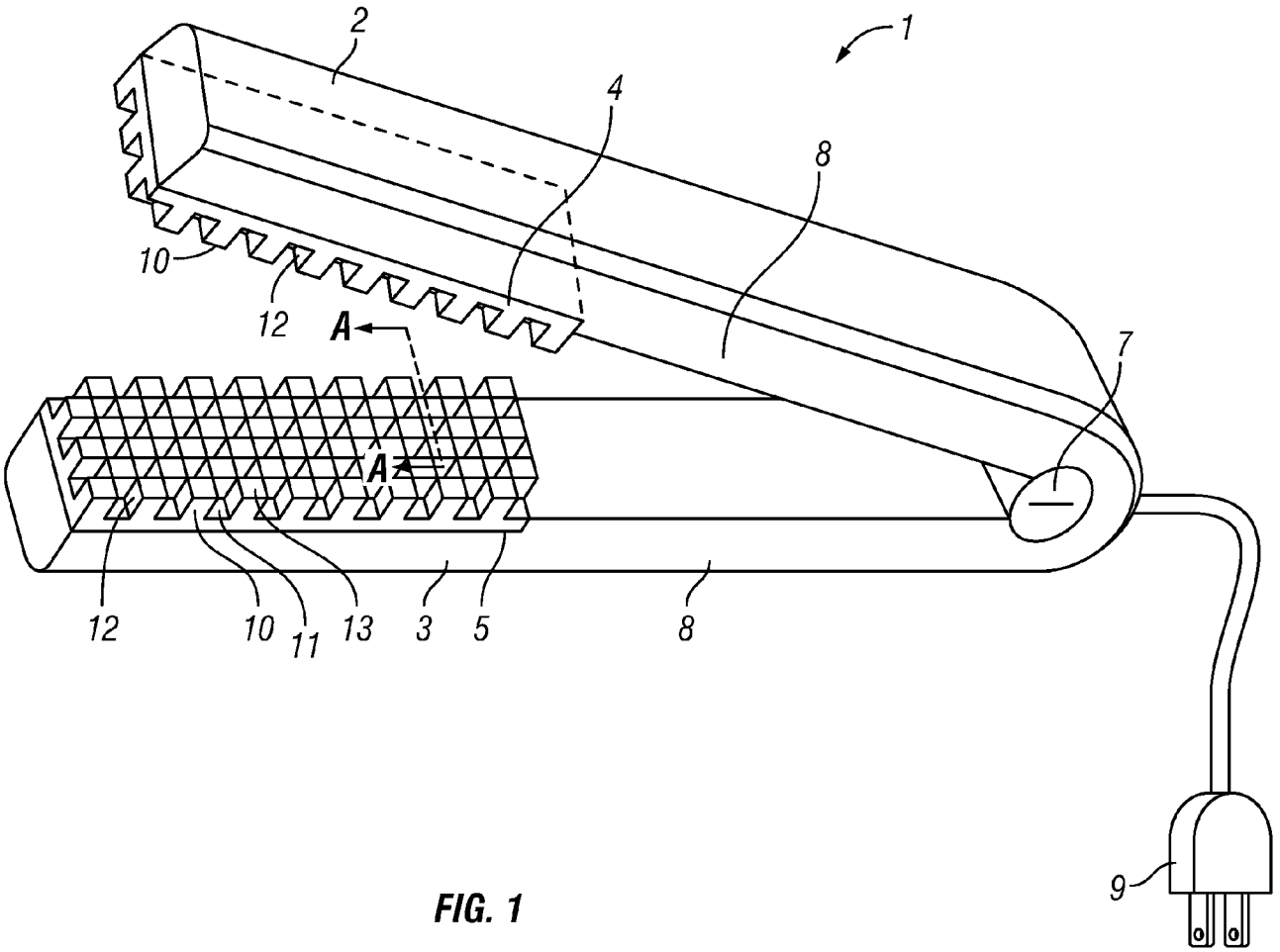
FIG. 1 is a perspective view of an embodiment of a volumizing device with the interlocking plates in a non-interlocked position according to the invention.

FIG. 1 shows a volumizing device 1 that consists of a pair of arms 2 and 3 that are joined by a pivot 7. At one end of each arm there is an interlocking plate 4 and 5, and at another end of each arm there is a handle portion 8. In an embodiment, the pivot is a hinge, such as a barrel hinge or floating hinge, that allows for the interlocking plates to be clamped together in a parallel fashion. In an embodiment the pivot joins the arms at an end of the arm such that the interlocking plate and handle portion of each arm are not separated by the pivot. In another embodiment the pivot joins the arms such that the interlocking plate and handle portion of each arm are located on opposite sides of the pivot.

The interlocking plates have a long axis in the direction of the length of the arms and a short axis in the direction of the width of the arms. Either or both of the interlocking plates are heated by a heating element located within the arm. The heating element heats an interlocking plate by any conventional heating method including, for example, electrical resistance, induction, infrared, combustion, or steam. The heating element heats an interlocking plate to an operating temperature from about 250° F. to about 430° F. The temperature, as well as an on/off function, in some embodiments is controlled by an analog or digital circuit located, for example, within an arm of the device. In an embodiment the device is powered by an internal power supply, such as a battery. In another embodiment the device is powered by an external source through a power cord 9.

Figure 2:
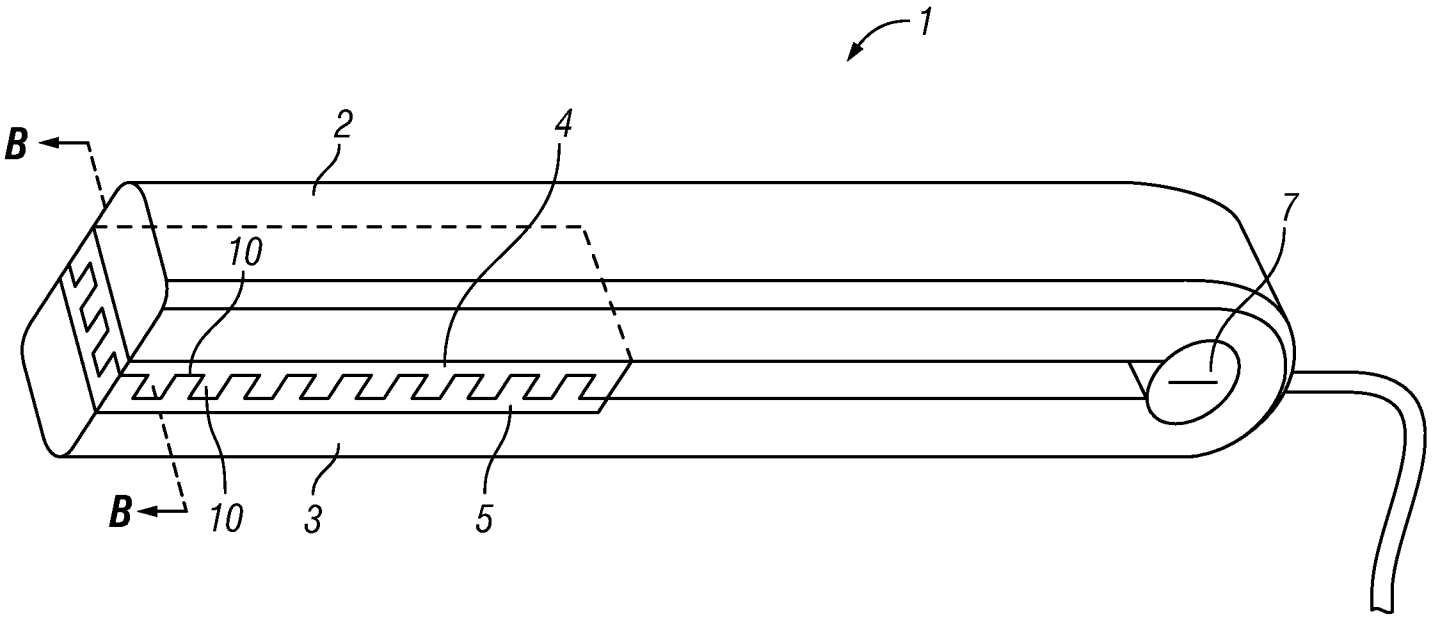
FIG. 2 is a perspective view of the embodiment shown in FIG. 1 with the interlocking plates in a an interlocked position.
Figure 3:
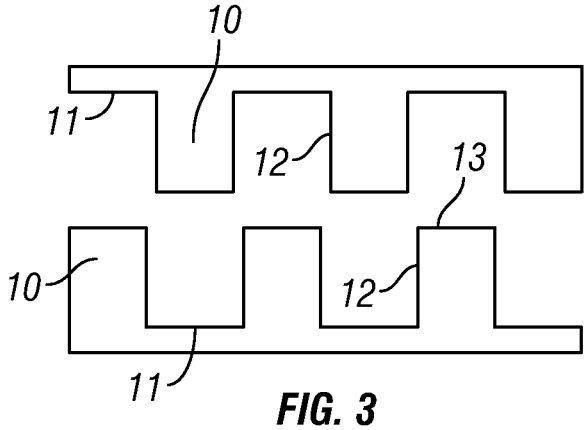
FIG. 3 shows section A-A of the FIG. 1.

The interlocking plates have a complementary design such that, when the ends of the arms at which they are located are clamped together, the interlocking plates interlock with each other, as shown in FIG. 2. When in the interlocked position, the individual teeth on an interlocking plate mesh with complementary teeth on the other interlocking plate. While in use, the interlocking plates clamp on an under layer of hair and at least one of the interlocking plates is heated in order to set the hair in a shape determined by the shape of the interlocking plates.

Each interlocking plate consists of a two-dimensional array of separated individual teeth 10 separated on all sides by spaces 11. The embodiments of FIGS. 1, 2, 3, 4, and 5 show the individual teeth arranged in a checkerboard fashion in rows and columns. In an embodiment, an individual tooth consists of a square prism with flats sides 12 and a flat top 13 surrounded on each of its four sides 12 by a space 11 that is also of square prism shape and similarly sized to the individual tooth. Though shown in a checkerboard pattern in FIG. 1, the individual teeth can be arranged in any regular pattern or in an irregular array without departing from the spirit of the invention. As show in FIG. 2, the teeth 10 on each plate interlock with the complementary spaces 11 on the opposite, mating interlocking plate. In some embodiments, the teeth on opposing plate pairs have a pattern or array that is the inverse of the opposing plate. Alternatively, in other embodiments, a plate has more spaces than teeth and, when the interlocking plates interlock, a space on one plate has a complementary space, instead of a complementary tooth, on the other plate.

Figure 6:
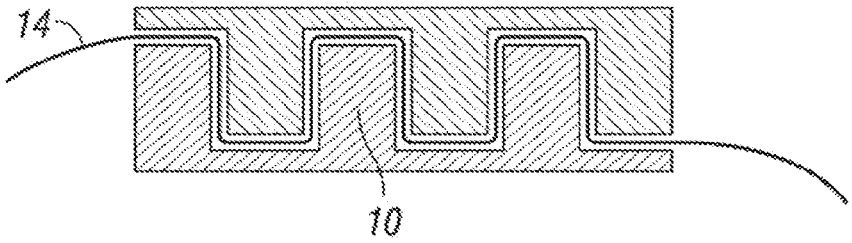
FIG. 6 shows a single hair being bent or creased by the interlocking plates and showing crease points according to the invention.

When the heated plates clamp an under layer of hair, the hair is bent and formed by the heated plates to create a matrix of piers which serve to support the upper visible layer of hair and hold it away from the head, thus creating the appearance of greater hair volume. The hair treated by the device takes the shape of the teeth. FIG. 6 shows a cross section of the individual teeth from FIG. 4 while the device is in use, with a hair 14 being bent or folded in an alternating tooth and gap in the checkerboard pattern found in the embodiment of FIGS. 1, and 2.

The array of alternating gap and tooth design not only creates a strong support structure in the lower layers of hair, but it also does this without creating a clear pattern that is visible in the upper layer as is the case using known crimping devices. This is because each tooth creates a firm support pier in the hair that alternates with surrounding recessed piers, thus breaking up and obscuring any clear pattern of folds in the hair. This is in sharp contrast to the long, accordion pleat folds left in the hair by the long, columnar teeth of known crimping devices, which leave a clear pleated or crimped pattern that is visible in the upper layers of hair.

FIG. 1 shows each plate having 6 columns and 18 rows, however the number of rows and columns can be as few as two and as many as 20 or greater. In an embodiment, the height of the teeth ranges from about 4 to about 25 mm, but it may exceed this if it is desired to achieve the appearance of even more volume. Further in embodiments, the height of teeth on the same or complementary interlocking plates may vary.

In the embodiments shown in FIGS. 1, 2, 3, 4, and 5, the teeth are rectangular prisms having square bases and flat square tops. The long axis length of each tooth may range from about 4 mm to about 25 mm and short axis length from about 4 mm to about 25 mm, although other dimensions are within the scope of the invention.

Figure 4:
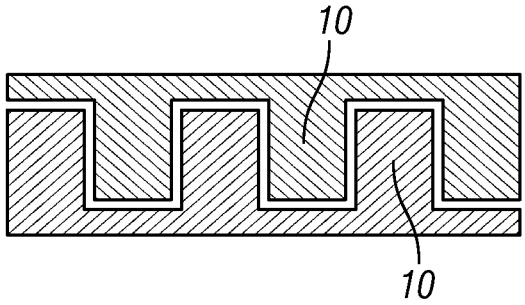
FIG. 4 shows section B-B of the FIG. 2.
Figure 5:
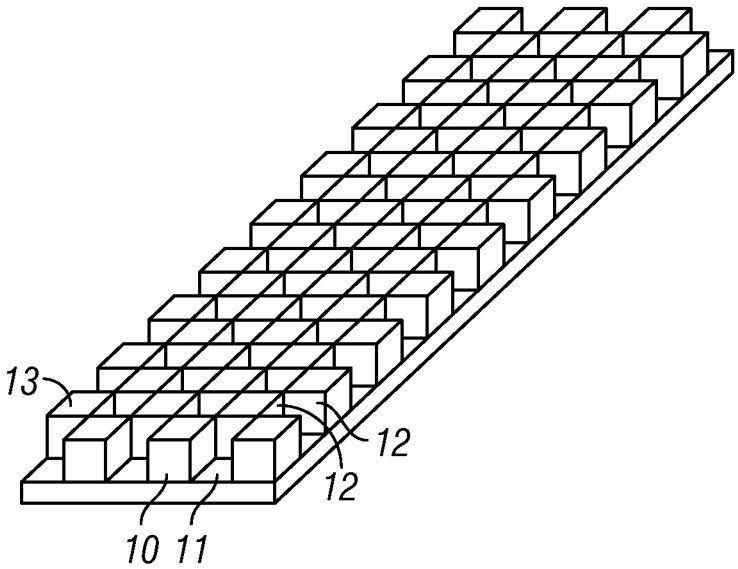
FIG. 5 is an isometric drawing of an interlocking plate showing a two-dimensional array of separate, individual teeth with flat top surfaces according to the invention.

When the plates are clamped together, as shown in FIGS. 4 and 6, the teeth arrangement leaves small gaps between the teeth on one plate and the teeth on the other plate to fit the hair that is treated and bent or folded, as shown. The complementary individual teeth of the interlocking plates comprise gaps that accommodate an amount of hair intended to be treated at once. Thus, the gap may be made larger or smaller to accommodate various amounts of hair to be treated. The width of the interlocking plate ranges from about 8 mm for short hair and up to about 75 mm or more for longer hair. The long axis length of the plate ranges from about 12 mm to about 125 mm or more.

In addition to the tooth configuration shown in the embodiment of FIG. 1 there are several related and alternative embodiments of tooth systems for lifting hair to create volume.

Figure 8:
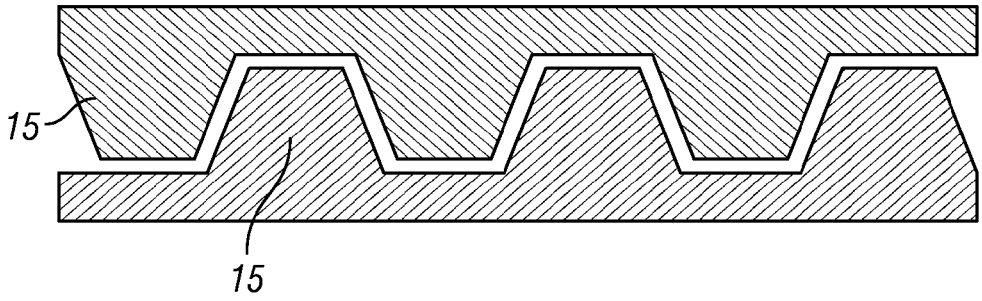
FIG. 8 shows a cross section of a tooth embodiment of the invention in which trapezoid-shaped teeth are arranged as individual, separate teeth in a two-dimensional array.

FIG. 8 shows a cross section of an embodiment with trapezoid teeth 15 with a flat top surface. In embodiments, the trapezoid teeth are arranged in a waffle or checkerboard pattern and function similarly to the square teeth of the embodiment shown in FIG. 1.

Figure 9:
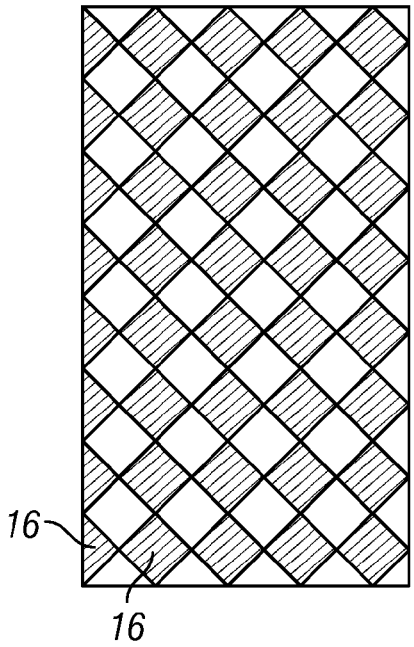
FIG. 9 shows an interlocking plate with a diamond shaped tooth embodiment of the invention.

FIG. 9 shows a diamond or an angled tooth 16 pattern in a checkerboard-like embodiment with flat top tooth surfaces. In embodiments, the shape of the tops and the bases of the individual teeth are rectangular, square, diamond, trapezoidal, round, oval, elliptical, triangular, pentagonal, hexagonal, or any other polygon or geometric shape. In some embodiments the individual teeth are prisms, truncated prisms, antiprisms, pyramids, flat-topped pyramids, and other polyhedrons. Further, in these embodiments the teeth are individual teeth surrounded by spaces and projecting from the surface of the interlocking plate.

Figure 10:
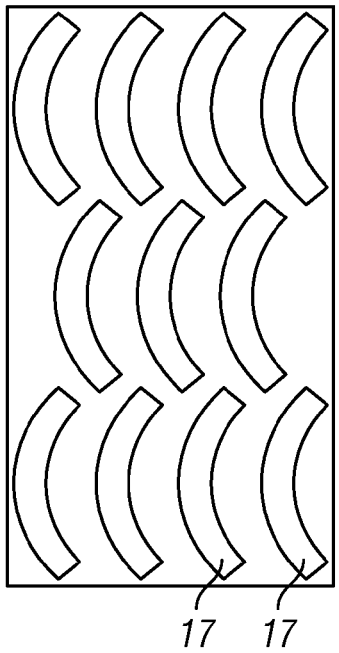
FIG. 10 shows an interlocking plate with a curved shaped tooth embodiment of the invention.

Non-rectilinear designs, such as those shown in FIG. 10 of curved teeth 17 are also within the scope of the invention. In some embodiments the teeth are S-shaped, or other curved shapes and consist of individual and separated teeth that are arranged in patterns, such as in rows and columns.

In some embodiments the teeth are arranged in a variety of patterns. These arrangements include rows and columns not parallel to either the long or short axes of the interlocking plate. Further, in some embodiments rows or columns of teeth are not parallel to other rows or columns of teeth and are not in a symmetrical pattern of rows and columns. In some embodiments the teeth are in a spiral pattern, a zig-zag pattern, a radial pattern, or any combination thereof. In some embodiments the teeth are arranged in a two dimensional array on an interlocking plate in an irregular or random pattern. In addition in some embodiments, a variety of tooth patterns co-exist on the same interlocking plate, in different sections of the plate. In some embodiments complementary interlocking plates have different shaped teeth and different patterns of teeth that mesh and interlock with one another.

Figure 7:
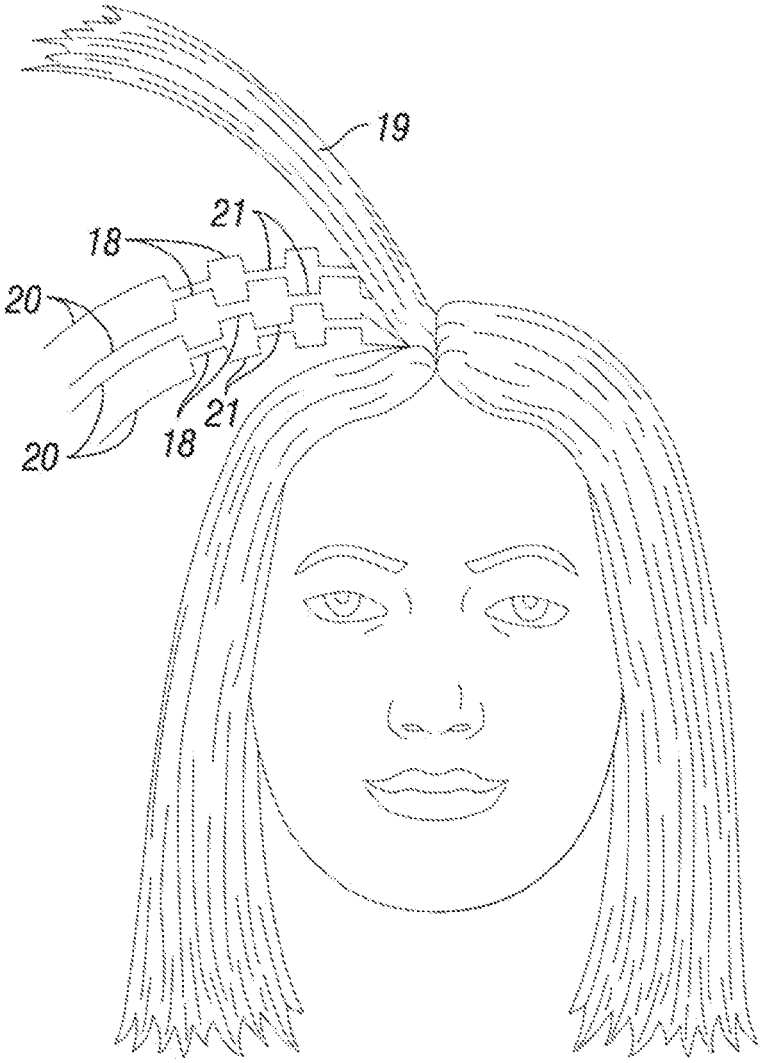
FIG. 7 shows an upper layer of hair supported by a treated under layer of hair which forms platforms according to the invention.

FIG. 7 shows a table-type support 18, created by the flat top surface of the individual teeth of an interlocking plate, and an array of piers with table-type supports providing a foundation for support to the upper layers 19 of hair. The short spans between piers, by virtue of the alternating tooth design, enhance hair support. The individual, alternating teeth that form the piers break up the pattern in the hair making it less visible, while adding to the strength of the foundation. In some embodiments the tops of the teeth are concave, convex; or any combination of curves, flat sections, indentations, projections and other shapes. In some embodiments the top surfaces of the teeth are smooth, ridged, textured, uneven, stepped, or any combination thereof. In some embodiments the tops of the individual teeth do not comprise a top surface and instead comprise a vertex or apex.

The sides 12 of the individual teeth shown in the embodiment in FIG. 1 have flat sides projecting perpendicular from the interlocking plate and the individual teeth shown in the embodiment in FIG. 8 have flat sides projecting at an obtuse angle to the interlocking plate. In some embodiments the sides of a tooth all project from the interlocking plate at the same angle and in some embodiments at least one side of a tooth projects from the interlocking plate at an angle different than at least one of the other sides of the tooth. In some embodiments the sides of the individual teeth are curved, stepped, faceted or textured.

Figure 11:
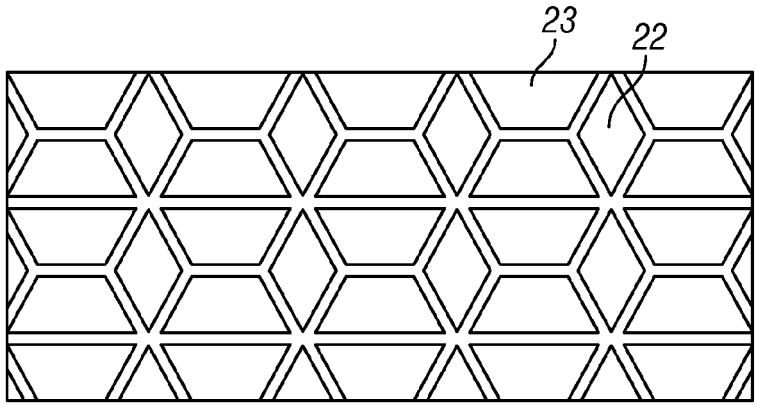
FIG. 11 shows an interlocking plate with a trapezoidal and diamond shaped tooth embodiment of the invention.

As shown in FIG. 11, in some embodiments each plate has any combination of types of individual teeth 22, 23, with varying or similar size, heights, shapes, top surfaces, and types of sides. In some embodiments a device has interchangeable plates with different types of individual teeth, with varying or similar size, heights, shapes, top surfaces, and types of sides. In some embodiments, the interchangeable plates are in pairs of complementary plates, and in some embodiments an interlocking plate has a plurality of complementary plates with different individual tooth configurations.

In some embodiments the interlocking plates are flat and rectangular, as shown in the embodiment in FIG. 1. In some embodiments, the interlocking plates are curved along either of their axes or both. In some embodiments, the interlocking plates have both curved and flat sections. Also in some embodiments, the interlocking plates are non rectangular in shape, including, for example, interlocking plates in the shape of circles, ovals, triangles, and other polygons and geometric shapes. The plate shape is independent of the pattern of the individual teeth. In some embodiments a circular interlocking plate has a checkerboard tooth pattern or a radial tooth pattern and in some embodiments a rectangular plate has a radial tooth pattern or a checkerboard tooth pattern.

In some embodiments, the overall device, including the arms, and the interlocking plates are straight, similar to existing crimping devices, and in some embodiments the overall device or components thereof are curved, including, for example, along the long or short axes of the arms. In an embodiment, a curved volumizing device is curved to be better adapted to more easily reach the back of the head or to match the curvature of the head. In some embodiments, the overall device is made of smaller components to suit travel applications. In some embodiments, the travel version has as few as two columns of individual separate teeth in any of the above described patterns.

In some embodiments, the construction of the interlocking plate is made of ceramic or metal, including, for example, aluminum, aluminum alloys, copper, steel, iron, zinc and nickel alloys. In some embodiments, the metals are coated with various materials, including, for example, silicone, anodized metal, Teflon, ceramics, including, for example, tourmaline and titanium-infused ceramics or some combination thereof. In some embodiments the teeth have both thermally conductive and insulating layers and contain materials designed to create friction to help hold the hair in place during treatment. Fabrication of the interlocking plates and teeth is done with any manufacturing method, including, for example, die casting, mold casting, extrusion, milling, drawing, laser cutting, and other metal forming and fabrication methods.

Figure 12:
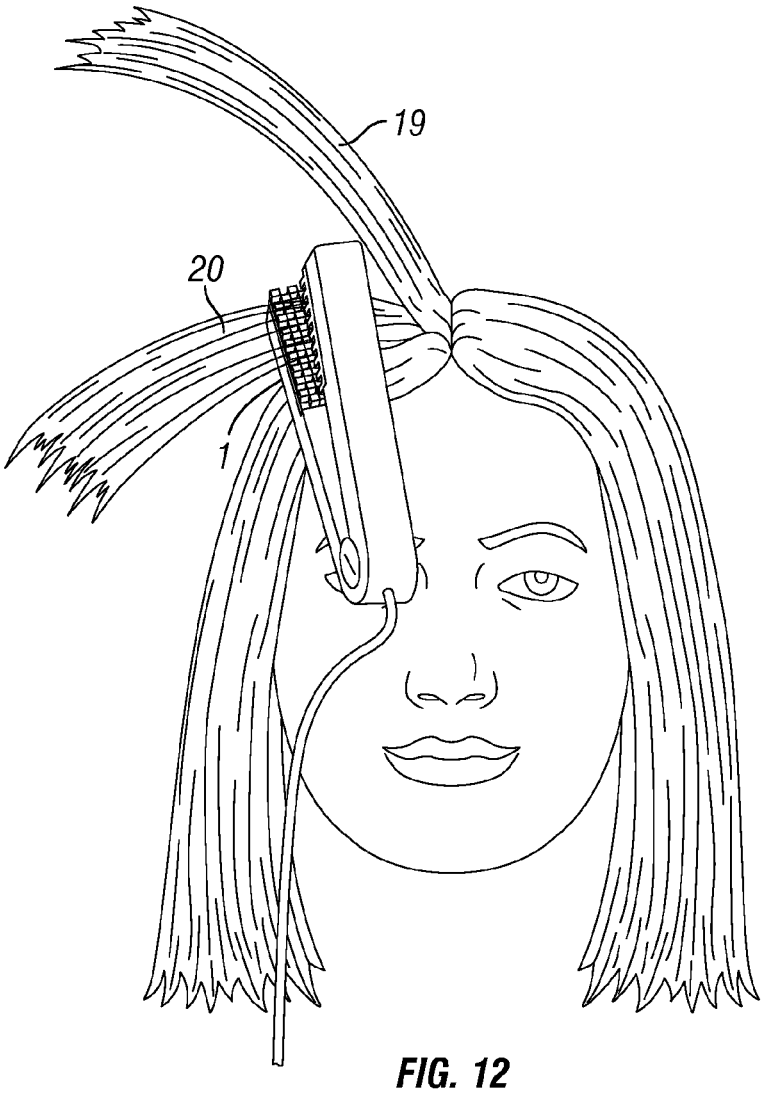
FIG. 12 shows a user employing the device according to the invention.

Referring now to the operation of a volumizing device such as that of the embodiment shown in FIG. 1, the device 1 consists of two mating, heated interlocking plates 4 and 5 that clamp and interlock in a jaw-like fashion onto the under layers of the hair 20 as shown in FIG. 12. In embodiments, the interlocking plates consist of separate and individual teeth arranged in a two dimensional array or pattern as described above. When the plates are clamped together as shown in FIGS. 2 and 6 the teeth arrangement provides small gaps between the plates in order to fit the treated hair. FIG. 12 shows a hair treatment device in use on a person's hair with the plate and teeth design described here.

When a lower layer of hair is clamped between the heated plates of the device as shown in FIG. 6, each treated hair is bent over each tooth, creating discrete bends, folds or creases in the hair. The hinging of the device enables the mating interlocking plates to meet in a parallel fashion when clamped on the hair. In some embodiments, each tooth will bend the hair from about 60 to about 120 degree angles, multiple times per tooth. In the embodiments shown in FIGS. 1 and 6, each tooth will bend a strand of hair 14 at 90-degree angles, a total of four times per tooth as shown in FIG. 6. As shown in FIG. 7, each tooth will create a raised flat surface 18 in the under hair layer 20 for the upper hair layer 19 to rest on and a lower flat surface 21 that rests against the scalp or other hair in order to provide a firm support for the upper layer of hair. As shown in FIG. 7, when a segment of hair is placed over the entire active heated surface of the interlocking plate, and clamped briefly, a strong three-dimensional support matrix of piers is created in the under layer of treated hair, which supports the upper layer which remains untreated by the volumizing device. This process can be repeated as far down the hair shaft as desired and around the entire head of hair. Further the process may be repeated so that multiple layers of under layers of hair create support matrices that are stacked onto each other to create even greater volume in the user's hair.

By virtue of a checkerboardlike three-dimensional alternating teeth pattern, portions of hair that are folded along a given row serve to support the neighboring hair portions in adjacent rows that are folded in the opposite direction. These alternating hair folds create a strong foundation of support due to a grid of flat topped piers that are more stable and less likely than hair treated with columnar teeth, found in crimping devices, to collapse in a domino cascading fashion. This system also minimizes the spans between piers, so that the upper or outer layer of hair is better supported. This individual tooth arrangement creates a more laterally stable platform to hold the upper hair up and away from the head or scalp, thereby adding the volume desired and holding it for long periods of time.

This alternating tooth checkerboard design provides this support without leaving a distinct visible pattern in the hair, due to the individual, flat-topped teeth and their alternating arrangement on the interlocking plates. Because each tooth alternates with gaps on all sides, any clear pattern of folding in the hair created by each raised tooth is broken up and obscured by the adjacent gaps between the teeth, especially when concealed beneath an upper layer of hair not treated by the volumizing device. This is in contrast to the long, sharp-peaked, accordion pleated folds left in the hair by the long, saw tooth columnar teeth of a crimping device, which leave a clear pleated or crimped pattern that is clearly visible in the upper layers of hair.

Further, the device creates volume and lift without creating undesired frizz in the lower layers that protrudes into the upper visible layers. When a segment of hair is placed over the entire active surface of the interlocking plate, and clamped briefly between two interlocking plates, a strong three-dimensional support system is created in the lower layer of treated hair that supports the upper visible layer. The outer or upper hair layer remains untreated. This process can be repeated as far down the hair shaft as desired, thereby building volume on the top and on the sides of the head for a long-haired user. It can also be repeated in an under layer close to the scalp, over the entire head of hair, adding volume in the back of the head.

In summary, these plates impart to the hair a foundation of strong support designed to create, lift and add volume in hair, while minimizing a visible pattern in the hair and without creating undesired frizz.

While the foregoing written description of the embodiments enables one of ordinary skill to make and use a hair volumizing device as described, those of ordinary skill will understand and appreciate the existence of variations, combinations, and equivalents of the specific embodiments, methods, and examples herein. The specification described here should therefore not be limited by the above described embodiment, method, and examples, but by all embodiments and methods within the scope and spirit of the embodiment as claimed.

The invention claimed is:

1. A device for volumizing hair, comprising:

a first arm comprising a first interlocking plate;

a second arm comprising a second interlocking plate;

at least one heating element associated with any of said first interlocking plate and said second interlocking plate; and a pivot positioned between said first arm and said second arm and arranged to allow relative movement of the interlocking plates between an interlocked position and a non-interlocked position;

said first and second interlocking plates each comprising a two dimensional array of outwardly projecting individual teeth;

wherein the array of outwardly projecting individual teeth of the first interlocking plate is interlockingly complementary to the array of outwardly projecting individual teeth of the second interlocking plate;

wherein each individual tooth comprises a flat top surface; and wherein the two dimensional array of individual teeth comprises a checkerboard pattern.

2. The device of claim 1, wherein the individual teeth comprise rectangular prisms.

3. The device of claim 1, wherein when in the interlocked position the individual teeth on the first interlocking plate are not in contact with the individual teeth on the second interlocking plate and are separated by a gap.

4. The device of claim 1, wherein the individual teeth comprise;

a top surface parallel to the interlocking plate, and sides projecting perpendicularly from the interlocking plates.

5. The device of claim 1, wherein at least one individual tooth comprises:

at least one angled side projecting from the interlocking plate at a non-perpendicular angle.

6. The device of claim 1, wherein the individual teeth comprise prisms projecting from the interlocking plate.

7. The device of claim 6, wherein the bases of the individual teeth are regular polygons in shape.

8. The device of claim 1, wherein the individual teeth comprise truncated prisms.

9. The device of claim 1, wherein at least one interlocking plate comprises individual teeth of at least two different shapes.

10. The device of claim 1 wherein the two dimensional arrays of individual teeth on the interlocking plates are shaped for creating a three dimensional matrix of raised flat surfaces in an under layer of hair capable of supporting an upper layer of hair.

* * * * *